US010077565B2

(12) United States Patent
Barrego

(10) Patent No.: US 10,077,565 B2
(45) Date of Patent: Sep. 18, 2018

(54) EDGE OVERLAY FOR LAYERED INSULATIVE BLANKET

(71) Applicant: PRIMESOURCE BUILDING PRODUCTS, INC., Irving, TX (US)

(72) Inventor: Peter J. Barrego, Newport, RI (US)

(73) Assignee: PrimeSource Building Products, Inc., Irving, TX (US)

( * ) Notice: Subject to any disclaimer, the term of this patent is extended or adjusted under 35 U.S.C. 154(b) by 802 days.

(21) Appl. No.: 13/908,037

(22) Filed: Jun. 3, 2013

(65) Prior Publication Data

US 2013/0323459 A1 Dec. 5, 2013

Related U.S. Application Data

(60) Provisional application No. 61/655,763, filed on Jun. 5, 2012.

(51) Int. Cl.
*E04G 21/24* (2006.01)

(52) U.S. Cl.
CPC ..... *E04G 21/246* (2013.01); *Y10T 428/2405* (2015.01); *Y10T 428/24215* (2015.01)

(58) Field of Classification Search
CPC ..... E04G 21/246; Y10T 428/24215; Y10T 428/2405
USPC ..... 428/104, 124
See application file for complete search history.

(56) References Cited

U.S. PATENT DOCUMENTS

| | | | | |
|---|---|---|---|---|
| 2,927,626 | A | 3/1960 | Corwin et al. | |
| 3,987,592 | A | 10/1976 | Herminghaus et al. | |
| 4,038,447 | A | 7/1977 | Brock | |
| 4,485,137 | A | 11/1984 | White | |
| 4,522,673 | A | 6/1985 | Fell et al. | |
| 4,590,714 | A | 5/1986 | Walker | |
| 4,642,868 | A | 2/1987 | Pandell | |
| 5,549,956 | A | 8/1996 | Handwerker | |
| 5,855,978 | A | 1/1999 | Handwerker | |
| 5,874,150 | A | 2/1999 | Handwerker | |
| 6,474,022 | B1 * | 11/2002 | Double | B60J 7/10 135/115 |
| 6,797,352 | B2 | 9/2004 | Fowler | |
| 7,726,710 | B2 | 6/2010 | Handwerker | |
| 7,745,353 | B2 | 6/2010 | Arthurs et al. | |
| 2005/0170720 | A1 | 8/2005 | Christiansen et al. | |
| 2008/0141604 | A1 | 6/2008 | Arthurs et al. | |
| 2008/0193716 | A1 | 8/2008 | Arthurs et al. | |
| 2011/0139349 | A1 | 6/2011 | Handwerker | |

* cited by examiner

*Primary Examiner* — Brian Handville
(74) *Attorney, Agent, or Firm* — Fogarty LLP

(57) ABSTRACT

A heavy duty layered blanket having application in construction applications is disclosed. It includes an overlay around one or more edges of the blanket which resists tearing and wear. The overlay helps to assure that the layers of the blanket stay in place when placed in use, especially in heavy duty construction applications such as for curing concrete. Selective openings in the overlay facilitate attachment of multiple blankets to each other and related facilities, such as scaffolding.

8 Claims, 4 Drawing Sheets

EDGE OVERLAY FOR LAYERED INSULATIVE BLANKET

CROSS-REFERENCE TO RELATED APPLICATION

This application claims the benefit, pursuant to 35 U.S.C. § 119(e) of U.S. Provisional Application No. 61/655,763 filed Jun. 5, 2012. The entirety of the aforementioned priority application is incorporated herein by reference.

BACKGROUND OF THE INVENTION

The present disclosure relates to curing blankets, having edge overlays to reinforce and seal blanket edges and provide selective attachment areas along blanket edges.

The concrete curing process occurs over a period of many days. Particularly crucial are the first twenty or so days of curing in which particular attention must be paid to maintaining optimum curing temperature. This is especially important in cold weather concreting when the heat of hydration must be kept within the concrete in order for proper curing. When heat is allowed to dissipate and temperatures are not maintained at optimal curing temperatures the possibility of freezing, and ultimately reduced structural integrity, is at risk. To minimize these problems, curing blankets are frequently used to retain heat in concrete during the curing process.

Optimal performance of curing blankets for this purpose, however, depends on means for keeping the blankets in place over the concrete surface being cured and maximizing the insulation value of the blanket. Failure to keep curing blankets in place can cause, among other things, longer curing times, improper curing, and potentially unwanted deposits of dirt and debris on the cured surface. Retention particularly becomes an issue during severe weather conditions where high winds are experienced.

In addition to maintaining the blanket itself in place, it is important to preserve the insulation value of the blanket. Thus, it is desirable to have a blanket where the insulation value of the blanket is maintained across its entire surface, i.e., from edge-to-edge with no, or minimal, penetrations in the blanket that would allow heat to escape.

One approach to achieving these objectives is disclosed in U.S. Pat. No. 4,590,714 ("'714 Patent") where fibrous insulating batt is held in place within a multi-layer tarpaulin by edge seams that keep the insulating batt from shifting or settling in a way that would leave uninsulated portions. (Column 2, lines 45-54; Column 3, lines 45-47). However, this construction also introduces numerous penetrations and compressed insulation around the edge of the blanket (FIGS. 1-3) where the insulation value of the blanket is substantially reduced.

Another concrete curing blanket with insulating media retained between outer waterproof membranes is disclosed in U.S. Pat. No. 5,874,150 ("'150 Patent"). But the insulating media of this blanket is only attached to the outer membranes of the blanket along two edges, top and bottom, thereby leaving the other two edges loose and exposed to the elements, construction debris, etc. The two open edges also reduce the overall insulative value of the blanket.

The '150 Patent also discloses means used by others in the prior art to hold insulating material in place within a concrete cure blanket. (Column 4, lines 12-19, FIGS. 2-4). Those means include fasteners or buttons strategically placed across the surface of the blanket holding the insulative layer(s) in place within the blanket. These fasteners or buttons, however, have proved to be ineffective because, inter alia, they often get caught or snagged by common jobsite concrete forming materials causing tears in the blanket which reduce its heat retention effectiveness. Also, because they protrude from the blanket, the fasteners and buttons can leave unwanted marks in the wet concrete.

BRIEF SUMMARY OF THE INVENTION

For the above reasons, among others, there is a need for improved curing blankets, wherein insulation material is firmly secured within a blanket on all edges of the blanket with means that minimize the number of penetrations through the blanket. The present invention fulfills these needs and provides further related advantages, as described below.

More particularly, the blanket of this invention provides an edge overlapping about much, or all, of the periphery of the blanket with selective penetrations in the overlay, but not necessarily the blanket. This assures that full insulation value is maintained across the full length and width of the blanket. It also allows selective, limited penetration through the blanket as needed to secure it rather than having multiple factory installed penetrations, via grommets or otherwise. Reduced penetrations increase the heat retention characteristics of the blanket. Selective penetrations about the periphery of the blanket allow for greater flexibility in using the blanket, for example, in vertical (hanging) concrete forms. In addition the selective penetrations facilitate application of the blanket to scaffolding during winter construction. The well placed penetrations about the periphery of the blanket facilitate selective attachment of the blankets to each other as well as the scaffolding.

BRIEF DESCRIPTION OF DRAWINGS

The drawings herein are for illustrative purposes only and are not intended to limit the scope of the present disclosure. In the drawings.

DETAILED DESCRIPTION OF INVENTION

Figure 1:
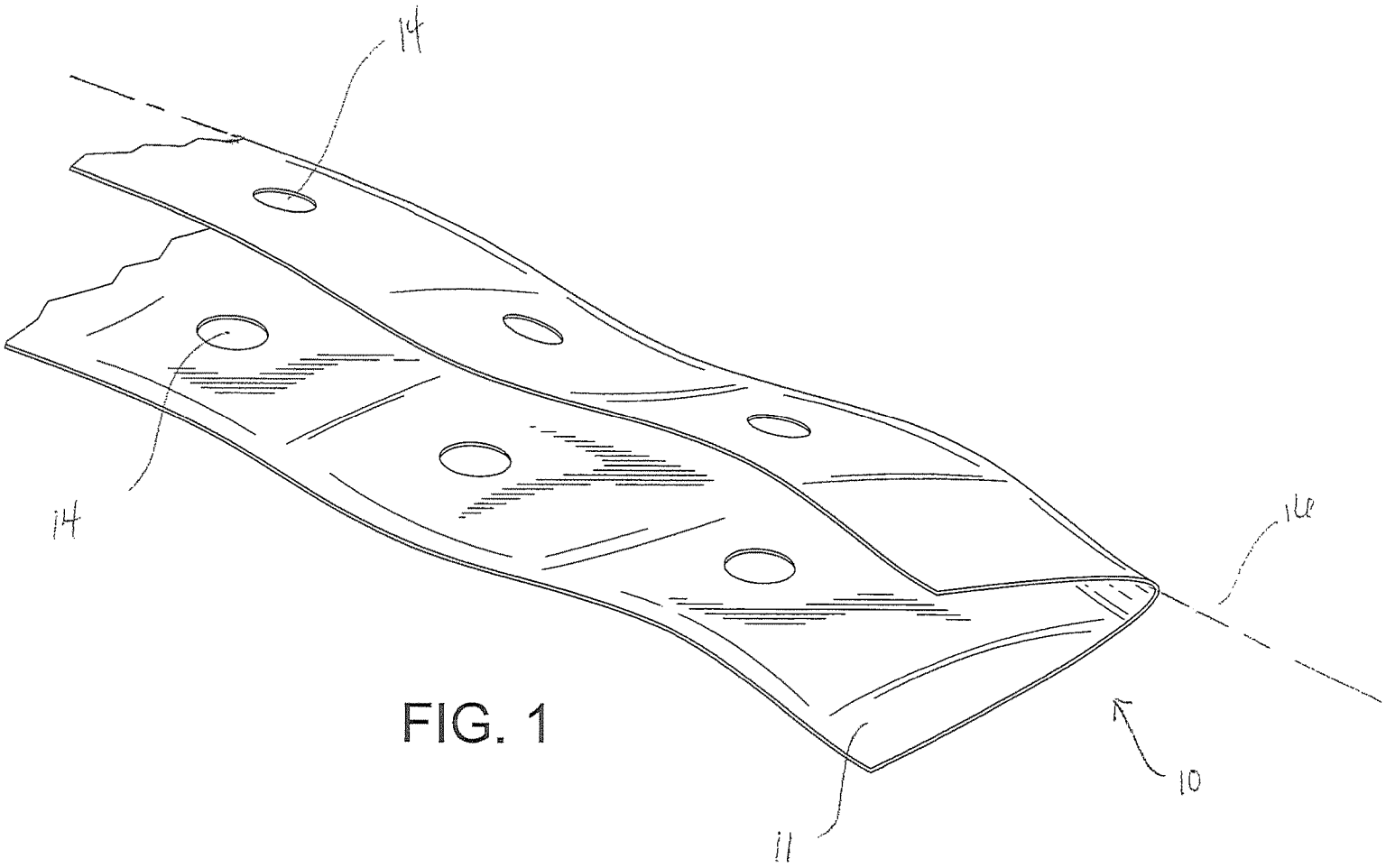
FIG. 1 shows one embodiment of an edge overlay.

Turning in detail to the drawings, FIG. 1 shows one embodiment of an edge overlay 10 for a curing blanket 12. The overlay provides edge protection for the blankets and is also configured to substantially seal one or more blanket edges. The overlay 10 also provides a strong, tear-resistant surface through which all layers of the curing blanket can be secured to each other thereby facilitating retention of insulation across the full width and height of the blanket 12.

As used herein, the term "blanket" should be broadly construed as any type of blanket, cover, sheet, or membrane used to shield or cover a surface. As such, the blanket is not necessarily limited to use for curing purposes. Rather, the blanket may be used as insulated scaffold sheeting, shelters, as well as in tents and other coverings. The blankets described herein necessarily include one or more edges suitable for sealing and reinforcement.

In the embodiment shown in FIG. 1, the edge overlay 10 is a folded sheet 11, which includes a plurality of perforations or openings 14 positioned about a central folding axis 16. The perforations are shown having a circular shape. The shape shown, however, is not to be construed as limiting. When the edge overlay 10 is in place over the edge of the blanket 12 (FIG. 3) the perforations 14 overlay aligned attachment areas 17 (FIGS. 3 and 4) along blanket edges. The attachment areas 17 are potential areas of the blanket thru which some securing means, whether a clip, rope or other fastener, can pass through the blanket. They are not actual penetrations through the blanket 12 but merely areas in alignment with perforations 14 in the overlay 10 through which fasteners can more easily pass. This arrangement decreases openings through the blanket which would otherwise reduce its insulation value and the number of weak points in the blanket that might be prone to tear or rupture. Such openings in the blanket, if allowed, would also promote unwanted entry points into the blanket of harmful moisture, debris, etc.

Perforations 14 in the overlay 10 are preferably spaced every 4-12" along the length of the overlay 10 arranged around one or more edges of blanket. This spacing allows maximum flexibility in the placement of fastening devices used to hold the blanket over a work space or to each other. The placement of perforations around the periphery of the blanket (FIG. 2) also facilitates fastening of blankets edge-to-edge whether in a vertical (hanging) application, for example, on a scaffold, or in a flat application such as a fresh concrete slab.

The edge overlay 10 is preferably manufactured from one or more materials substantially impervious to water such that overlay is configured to substantially seal one or more blanket edge, where a blanket edge is formed from a plurality of blanket layers in stacked arrangement, as described below. Suitable edge overlay materials include various types of fabrics and plastics, including, but not limited to polypropylene, polyethylene, nylon, or any other material that resists tearing and wear. A preferred material is one which is internally reinforced with a thermoplastic polyolefin scrim having warp and weft strands arranged in a weave pattern, providing multidirectional strength to the overlay. The overlay 10 should have sufficient toughness and tear resistance to facilitate secure attachment of the blanket 12 to another blanket or work space.

Each edge overlay 10 should have sufficient length to extend over a substantial portion of the curing blanket edge. The width of the edge overlay depends, in part, on the perforation size. The overall width of the edge overlay, however, is preferably about 2 inches to about 6 inches on each side of the blanket.

The edge overlay 10 is coupled to the curing blanket 12 (FIG. 2), using any coupling method. Stitching methods, however, are preferred. Stitching 18*a*, 18*b* may extend fully or partially along the length of a blanket edge. The edge overlay 10 may also be coupled to the blanket using various other methods such as heat sealing, hot air sealing, ultrasonic sealing, and adhesive lamination. Regardless of the coupling method used, the edge overlay is configured to substantially cover and seal at least a portion of blanket edges.

Figure 2:
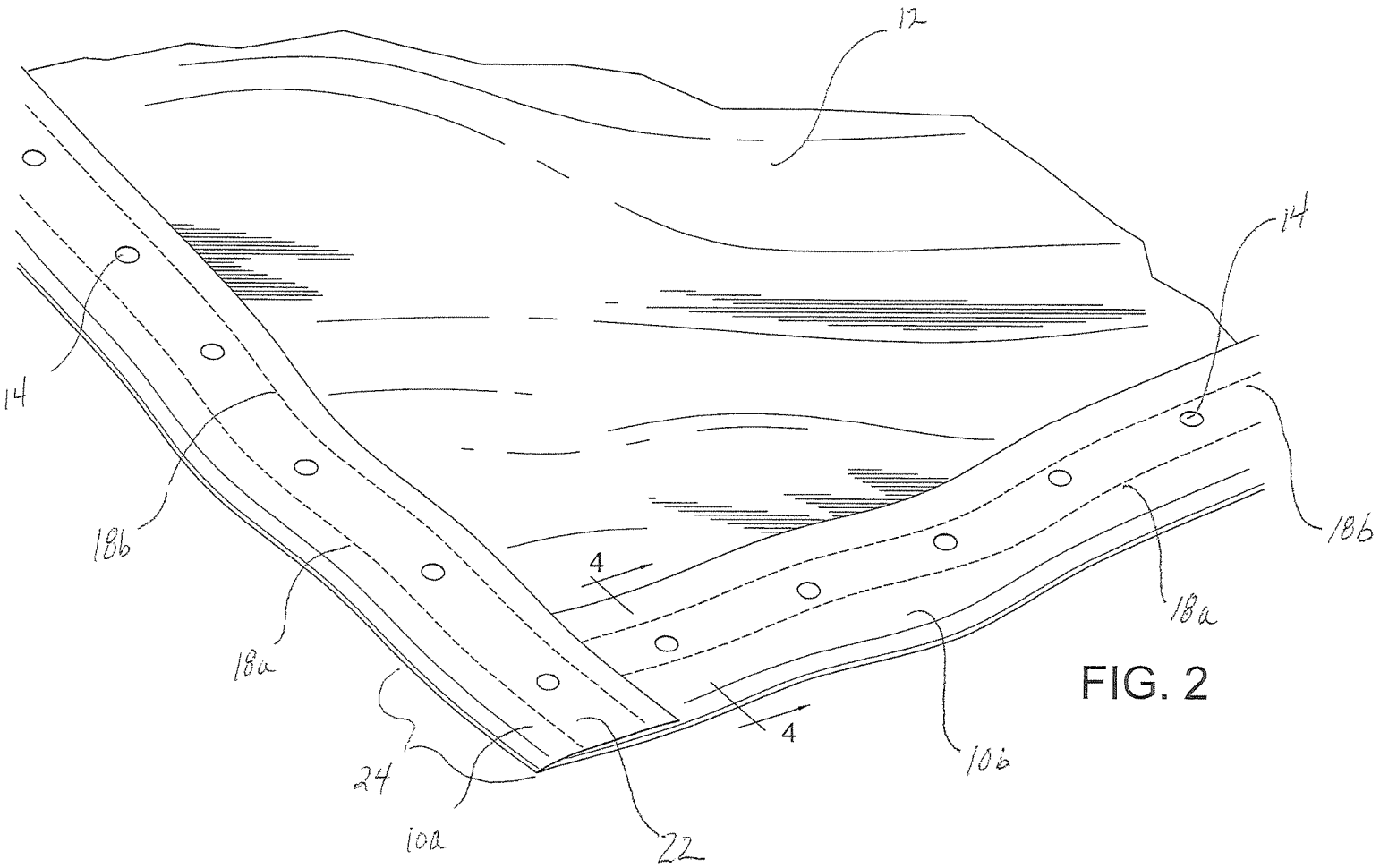
FIG. 2 shows a section of one embodiment of a curing blanket, having edge overlays.

Referring to FIG. 2, in one embodiment of the blanket, two stitching lines 18*a*, 18*b* are positioned on opposite sides of perforations 14, although any number of stitching lines can be used to secure the blanket edges. In the embodiment shown in FIG. 2 an outermost stitching line 18*a* is positioned along the periphery of the overlay, while an innermost stitching line 18*b* is positioned along the inner overlay edge. Preferred placement of both stitching lines 18*a* and 18*b*, or other coupling method used, is where the coupling means will pass through all layers of the blanket sufficiently distant from the outer edge of the overlay 10 that all layers of the blanket, particularly insulation layers, are retained across the full width and height of the blanket. (See FIG. 4). The embodiment of the blanket 12 in FIG. 2 also shows a corner blanket section 22, having edge overlays 10*a*, 10*b* that form an overlapped section 24. Alternative blanket configurations, however, may not necessarily include an overlapped section. Although not limited to any particular shape or size, curing blankets are typically manufactured in mat form, as shown, with a substantially rectangular shape. In some embodiments, blankets have a base width of five or six feet or a multiple thereof and a length of, for example, 100 feet.

In use, the curing blanket 12 may be configured for placement over a section of freshly poured and fully wetted concrete. Thus, the blanket functions to maintain the concrete in a wetted condition for a sufficient period of time to effect proper wet-curing thereof.

Figure 3:
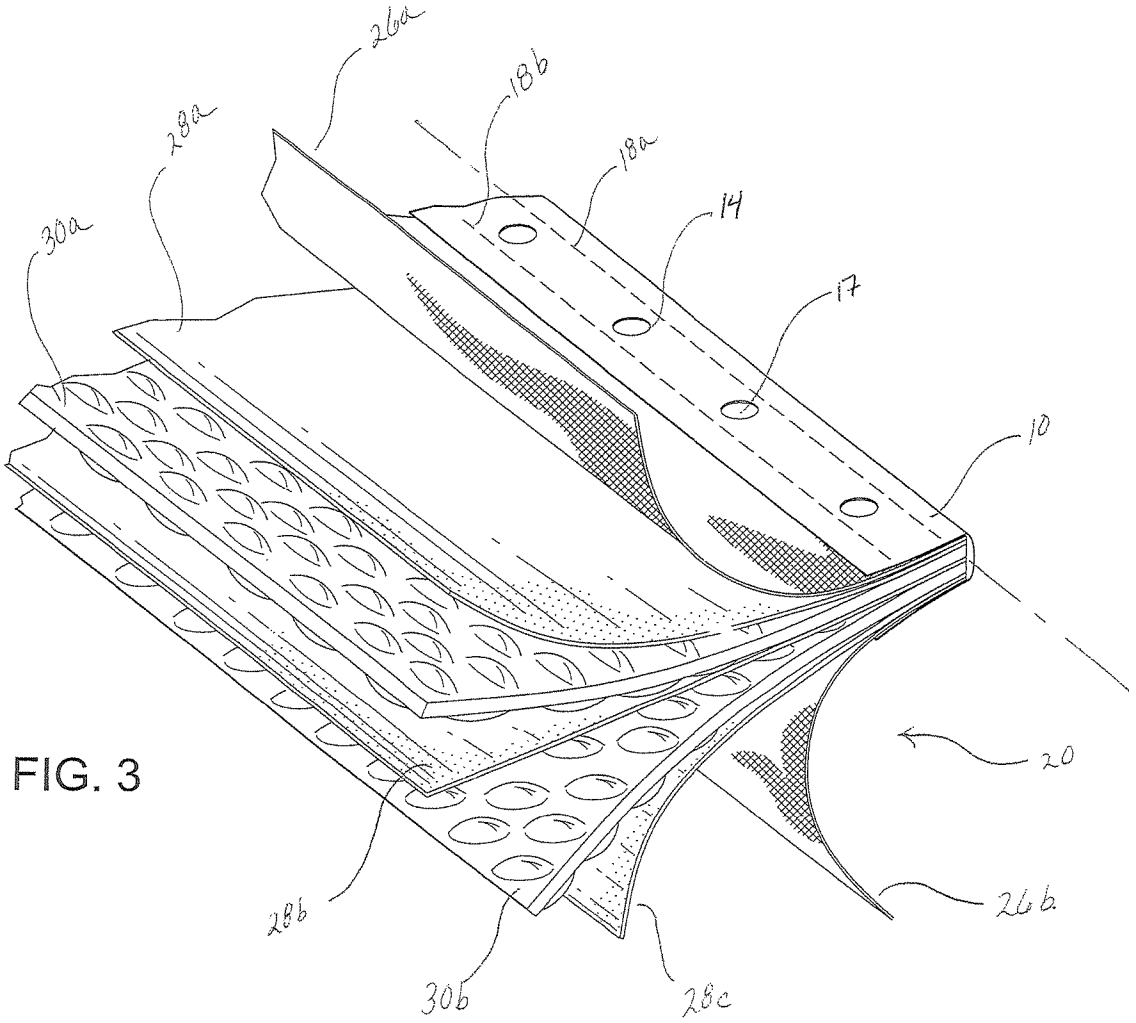
FIG. 3 shows a perspective sectioned view of a curing blanket, having edge overlays.
Figure 4:
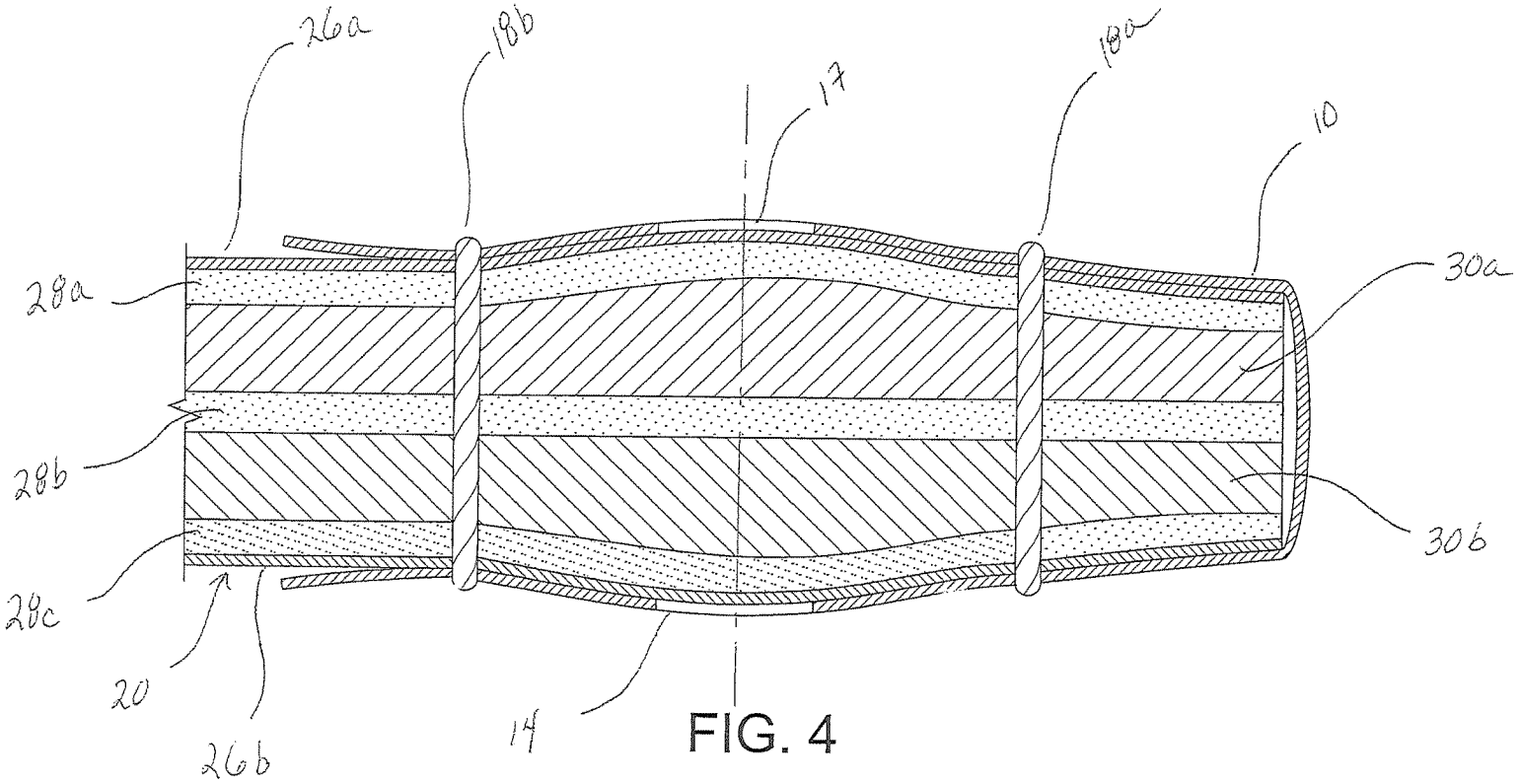
FIG. 4 shows a cross-sectional view of the curing blanket shown in FIG. 2, taken along line 4-4.

As shown, particularly in FIGS. 3 and 4, the curing blanket 12 can include a plurality of blanket layers 20 in stacked arrangement which together function to reduce the rate of evaporation of water on a curing surface and retain heat under the blanket. In one embodiment shown in FIG. 3, the plurality of blanket layers includes seven separate layers: two outer blanket layers 26*a*, 26*b*; three fibrous insulation layers 28*a*, 28*b*, 28*c*, and two bubble insulation layers 30*a*, 30*b*. The number of layers used in this embodiment, however, is not limiting. The overall number of blanket layers is generally application dependent.

Each outer blanket layer is preferably manufactured from plastic materials such as polyolefins, e.g. low density polyethylene or polypropylene. These materials may also incorporate a woven scrim in a reinforcing weave pattern that provides multi-directional strength. Each fibrous layer is preferably manufactured from porous and resilient materials configured to provide effective heat retention and ensure proper curing. Bubble layers also provide insulation to the blanket and are typically manufactured from substantially clear or translucent plastic materials. In the embodiment shown in FIGS. 3 and 4, the bubble layer is a substantially clear plastic bubble sheet having a single layer of bubbles formed therein, for entrapping air or another gas. Fewer or additional bubble layers may be specified, depending on the nature of the application. Alternatively, a polyethylene or polypropylene foam layer (not shown) or another suitable insulation material can be used as a substitute for, or in addition to, a bubble and/or fibrous layer. Fibrous and bubble layers useable in concrete cure blankets are, for example, described in U.S. Pat. Nos. 2,927,626; 4,038,447, and 4,485,137, the disclosures of which are incorporated herein by reference.

In a typical application, the assembled layers of the blanket 12 with overlay 10 secured in place around the periphery of the blanket, is taken to a work area, for example, a newly poured concrete pad 100 yards long and 5 feet wide. Because of the size of the pad multiple blankets are needed that are attached end-to-end. To secure the blankets to each other, suitable, selective penetrations through the blanket 12 are made at one or more of the attachment areas 17 in the blanket underlying the perforations or openings 14 in the edge overlay 10. A suitable fastener is then passed through adjoining openings 14 in the overlay and the underlying attachment areas 17 in the blanket to secure the blankets to each other over the newly poured concrete. In a situation where the blankets are hung vertically, fasteners can be passed through selective openings 14 in edge overlay 10 and through the attachment areas 17 in the blanket on two or more edges to fashion a wall of protection or security for the area under construction. The extra tear strength of overlay 10 and use of selective penetrations through the blanket provides a strong concrete cure blanket with maximum insulative value across the entire width and length of the blanket.

While embodiments of this invention have been shown and described, it will be apparent to those skilled in the art that many more modifications are possible without departing from the inventive concepts herein. The invention, therefore, is not to be restricted, except in the spirit of the following claims.

The invention claimed is:

1. A curing blanket, comprising:

a plurality of blanket layers in stacked arrangement extending substantially across the width and length of the blanket comprising one or more outer and insulative layers, and a separate strong, tear resistant edge overlay folded over and attached near multiple edges of the stacked blanket layers to substantially seal and reinforce the edges formed by the plurality of stacked blanket layers, the edge overlay having a plurality of openings positioned at intervals along the length thereof to facilitate attachment of the curing blanket to other blankets or stationary objects.

2. The curing blanket of claim 1, wherein the edge overlay is secured to the plurality of blanket layers with stitching.

3. The curing blanket of claim 1, wherein the edge overlay comprises tear resistant polyolefin sheeting with a woven polyolefin reinforcing scrim.

4. The curing blanket of claim 1, wherein at least one of the plurality of blanket layers comprises a protective weather proof coating.

5. An edge overlay for a multilayered blanket, comprising:

a strong, tear resistant sheet having a plurality of perforations positioned at intervals along the length thereof, wherein the sheet is folded over multiple edges of the blanket and attached thereto to substantially seal and reinforce multiple edges of the blanket.

6. The edge overlay of claim 1, wherein the edge overlay consists essentially of a polyolefin.

7. The edge overlay of claim 5, wherein the sheet includes a protective weatherproof coating.

8. The curing blanket of claim 1, wherein the openings in the overlay are between the folded edge of the overlay and where the overlay is attached to the stacked blanket layers.

* * * * *